United States Patent [19]

Kranz et al.

[11] 4,451,339

[45] May 29, 1984

[54] PREPARATION OF BLUE IRON HEXACYANOFERRATE-III PIGMENTS, AND THE PIGMENTS OBTAINED

[75] Inventors: Joachim Kranz, Ludwigshafen; Wolfgang Habermann, Mainz; Harry Distler, Bobenheim; Helmut Knittel, Ludwigsburg; Karl-Ludwig Hock, Ludwigshafen; Fritz Brunnmueller, Limburgerhof; Rolf Schneider, Mannheim, all of Fed. Rep. of Germany

[73] Assignee: BASF Aktiengesellschaft, Ludwigshafen, Fed. Rep. of Germany

[21] Appl. No.: 361,431

[22] Filed: Mar. 24, 1982

[30] Foreign Application Priority Data

Apr. 4, 1981 [DE] Fed. Rep. of Germany ..... 3113777

[51] Int. Cl.[3] ..... C25B 1/00

[52] U.S. Cl. ..... 204/91; 204/59 R

[58] Field of Search ..... 204/59 R, 91

[56] References Cited

U.S. PATENT DOCUMENTS

| | | | |
|---|---|---|---|
| 2,273,798 | 2/1942 | Heise et al. | 204/91 |
| 2,353,781 | 7/1944 | Neumark | 204/91 |
| 4,032,415 | 6/1977 | Sanders | 204/91 |

FOREIGN PATENT DOCUMENTS

| | | | |
|---|---|---|---|
| 697606 | 11/1979 | U.S.S.R. | 204/91 |

OTHER PUBLICATIONS

Chemical Abstracts, Band 92, Nr. 10, Mrz 1980, S. 573, Nr. 84930p, Columbus, Ohio, USA, N. N. Plotnikov et al.: "Berlin Whites", Otkrytiya, Izobret., Prom. Obraztsy, Tovarnye Znaki 1979, (42), 116–117.

Chemical Abstracts, Band 92, Nr. 6, Feb. 1980, S. 496, Nr. 49476y, Columbus, Ohio, USA & IN-A-137 245, (Counsil of Scientific and Industrial Research).

*Primary Examiner*—T. Tung

*Attorney, Agent, or Firm*—Oblon, Fisher, Spivak, McClelland & Maier

[57] ABSTRACT

Blue iron hexacyanoferrate-III pigments (I) are prepared by anodic oxidation of metallic iron in hydrogen cyanide, or a reaction medium containing hydrogen cyanide, at pH<7 and at an anode potential of ≦0.76 V (measured against a standard hydrogen electrode) to complex iron-II hexacyanoferrate-II compounds (II), which are then oxidized to (I) in a conventional manner. The oxidation of (II) is advantageously carried out with air or oxygen at pH 0–4 and at from 70 to 95° C., but can also be carried out at pH>8.

The process gives readily dispersible pigments (I) which are of high color strength and give brilliant, glossy colorations.

8 Claims, No Drawings

PREPARATION OF BLUE IRON HEXACYANOFERRATE-III PIGMENTS, AND THE PIGMENTS OBTAINED

The present invention relates to a process for the preparation of blue iron hexacyanoferrate-III pigments and to the pigments obtained by the process.

Blue iron hexacyanoferrate-III pigments (I) (C.I. Pigment Blue 27; C.I. No. 77,510) are commercially available under various names, such as Prussian blue, Berlin blue, milori blue or iron blue.

These blue pigments are obtained by oxidizing complex iron-II hexacyanoferrate-II compounds, which are also called Berlin white (II), with an oxidizing agent in dilute acid, such as chlorate/hydrochloric acid, or dichromate or air in dilute sulfuric acid ($pH<0.5$).

The chemical composition of Berlin white (II) and the blue iron hexacyanoferrate-III pigments (I) is complex, and within certain limits also depends on the production process. In the text which follows, II is represented by the (simplified) formula $$Me_2Fe[Fe(CN)_6] \quad (II)$$

and the blue pigments are represented by $$MeFe[Fe(CN)_6] \quad (I)$$

where Me is an alkali metal cation, preferably a potassium or sodium ion, an ammonium ion or a mixture of these cations.

Regarding the chemical composition of the compounds, reference may be made to H. Kittel, "Pigmente", Wissenschaftliche Verlagsgesellschaft mbH, Stuttgart, 1960, page 341/343 and the literature quoted therein.

In the prior art processes, the iron-II hexacyanoferrate-II (II) is prepared by precipitating iron-II salts with complex alkali hexacyanoferrates-II in aqueous solution. About 2 parts by weight of alkali metal salts are obtained per part by weight of "Berlin white" (II), which means substantial pollution of the effluent. Another disadvantage of the prior art process is that the salts contained in (II) must be washed out in a very time-consuming operation before the oxidation to I. This is also the case if the Berlin white is prepared by reacting freshly precipitated iron-II hydroxide with hydrogen cyanide in an alkaline medium or by reacting iron-II salts with hydrogen cyanide in the presence of an alkali metal hydroxide or ammonia at $pH>4$.

It is an object of the present invention to improve the process for the preparation of blue iron hexacyanoferrate-III pigments.

We have found that this object is achieved, and that the process for the preparation of blue iron hexacyanoferrate-III pigments (I) in which the iron-II hexacyanoferrate-II compound (II) is prepared, isolated and then oxidized to the blue pigment can be improved, by a procedure wherein the iron-II hexacyanoferrate-II compound (II) is prepared by anodic oxidation of metallic iron in hydrogen cyanide or a mixture of hydrogen cyanide and water, a $C_1$–$C_4$-alkanol, a $C_1$–$C_4$-alkanediol or a mixture thereof, as the reaction medium, at $pH<7$ and at an anode potential of $\leqq 0.76$ V—measured against the standard hydrogen electrode—at from $-20°$ to 150° C.

A high yield of highly pure complex iron-II cyano compound (II) is obtained by the process according to the present invention. Pollution caused by this process is very low, since virtually no by-products or coupled products are formed in the reaction. It is surprising that a virtually quantitative yield of the complex iron-II cyano compound (II) is obtained by anodic oxidation, ie. by electrochemical reaction of iron with hydrogen cyanide in an acid reaction medium (electrolyte). In contrast, in the prior art process, the complexes (II) are obtained only in an alkaline medium at $pH>8$.

The process is generally carried out by introducing the reaction medium, also called the electrolyte, into an electrolysis cell which has an iron anode and an iron or chromium/nickel/steel cathode and effecting electrolysis at an anode potential—measured against the standard hydrogen electrode—of $\leqq 0.76$ V at the desired temperature.

The process can be carried out batchwise or continuously. In the case of an industrial operation, the electrolyte is circulated in the cell.

In the batchwise procedure, electrolysis is continued until sufficient (II) has formed. The suspension is then filtered and the material on the filter is washed with water until it contains little or virtually no salt.

After the components consumed have been replaced, the filtrate can be re-used as the electrolyte.

In the continuous procedure, the electrolyte is circulated in the cell, and the iron-II cyano compound (II) formed is removed continuously from a portion of the electrolyte. The filtrate is recycled continuously to the system, after the constituents consumed have been replaced.

The (II) isolated can then be oxidized to $MeFe[Fe(CN)_6]$ pigments (I) in a conventional manner. The iron-II complex can, however, also be oxidized directly in the electrolyte, which is advantageous in the case of an industrial operation.

Suitable reaction media for the electrolysis include hydrogen cyanide and mixtures thereof with $C_1$–$C_4$-alkanols having a primary, secondary or tertiary hydroxyl group, $C_2$–$C_6$-alkanediols, diethylene glycol, triethylene glycol, dipropylene glycol, $C_3$–$C_6$-alkanepolyols, water and mixtures of these liquids.

The preferred reaction medium (electrolyte) is a mixture of hydrogen cyanide and water.

The electrolyte can contain from 100 to 0.001% by weight of hydrogen cyanide, and is preferably a mixture of 99.9–95% by weight of water and 0.1–5% by weight of hydrogen cyanide.

Conductive salts are advantageously added to the electrolyte for improving the conductivity and for doping of the iron-II cyano compounds (II). Suitable conductive salts are those of the prior art which are soluble in the above electrolytes in not less than the required concentration.

The amount of conductive salts is as a rule from 0.1 to 10% by weight, based on the electrolyte. Examples of suitable conductive salts are alkali metal, alkaline earth metal, earth metal and rare earth salts, such as those of lithium, sodium, potassium, rubidium, magnesium, calcium, strontium, aluminum and cerium, and also salts of metals from the iron group and of ammonium.

Examples of suitable anions are chloride, sulfate, bisulfate, monohydrogen and dihydrogen phosphate, bisulfite, cyanide, the hexacyanoferrate ions, hydrogen oxalate, oxalate, maleate and fumarate.

Ammonium and potassium salts are the preferred conductive salts, and ammonium chloride, ammonium hydrogen oxalate, potassium chloride, potassium bisulfate, potassium bisulfite and potassium hydrogen oxalate are particularly preferred, since the iron-II cyano complexes (II) obtained in the presence of these salts are oxidized to pigmentary forms which have a particularly high color strength and give very glossy reddish blue colorations.

The electrochemical reaction in which the iron is oxidized anodically and hydrogen is deposited at the cathode can be carried out at from −20° C. to 150° C., if necessary under superatmospheric pressure, and preferably at from −5° to +20° C. under atmospheric pressure. If the temperature exceeds 20° C., the reaction must be carried out under superatmospheric pressure because of the low boiling point of hydrogen cyanide.

Since the conductivity of the electrolyte increases with temperature, the electrolysis is carried out in particular at from 10° to 20° C.

An anode potential of $\leqq +0.76$ V (measured against the standard hydrogen electrode) should be maintained during the electrolysis at pH$\leqq$7. At a higher anode potential, dicyanogen and cyanate are formed, reducing the yield.

The electrolysis is preferably carried out at pH 1–6, in particular at pH 2–5.

The current density is as a rule from 30 to 5,000 A/m$^2$, and is advantageously from 200 to 2,000 A/m$^2$ in order to ensure a current efficiency of about 95% or more. At a current density >2,000 A/m$^2$, care must be taken that mass transfer is very good, so that no depletion of cyanide ions and consequent drop in current efficiency occur in the anode boundary layer. A current density of $\leqq$30 A/m$^2$ requires a higher concentration of hydrogen cyanide to ensure complexing of the anodically oxidized iron.

The reaction of give (II) can take place at fluidized bed or loose bed anodes, for example those comprising iron lumps, granules or turnings on an electrically conducting base, or compact iron anodes in the form of bars, blocks or sheets, or iron oxide anodes. In the case of fluidized bed and loose bed anodes, the anode material (iron) is separated from the cathode chamber by diaphragms or an anodically resistant screen or gauze of metal or plastic. Electrical contact between the loose bed or fluidized bed anode and the current source can be effected via the screen, if a metal screen is used, or via anodically resistant metal of carbon rods inserted into the loose material.

If compact iron anodes are used, it is advantageous if the anode-cathode distance is adjustable, otherwise the cell voltage must be increased with increasing consumption of the anode (by the formation of (II)) in order to keep the anode current constant. This adjustment can be made mechanically or manually as a function of the cell voltage.

Iron, high-grade steels and other conductive materials with a low hydrogen overvoltage are particularly suitable cathode materials. To reduce the hydrogen overvoltage, the surface of the cathode is advantageously coated with, for example, a nickel/aluminum/zinc alloy, a nickel, cobalt, molybdenum or molybdenum/iron alloy, tungsten, a tungsten/iron/nickel alloy or an iron/cobalt alloy (in each case having an iron content of from 65 to 95% by weight, German Laid-Open Application DOS No. 3,003,819 (No. P 30 03 819.8)), vanadium, a vanadium alloy or a sulfide of molybdenum, tungsten, nickel or cobalt.

Cells with compact iron anodes in the form of rods or plates are the preferred electrolysis cells. The distance between anode and cathode is preferably from 2 to 10 mm, and in particular from 3 to 6 mm.

The product (II) can be separated off and isolated from the electrolyte by filtering, centrifuging or decanting. In the case of filtration, a filtration aid is advantageously first added to the reaction mixture so that the filtration time can be substantially shortened. The filtrate can be re-used as the electrolyte, after the constituents consumed have been replaced.

Oxidation of the complex iron-II cyano compound (II) is carried out in a conventional manner, for example with chlorate, chlorine or hydrogen peroxide in aqueous suspension at pH<6.

Preferably, the oxidation of the Berlin white II obtained by the process according to the invention is carried out with air or oxygen in aqueous sulfuric acid suspension at pH 0–3 and at from 70° to 95° C. Softtextured reddish pigments I which have a very high color strength, are very readily dispersible and produce very brilliant colorations are obtained under these conditions.

The oxidation is preferably carried out at from 75° to 85° C. The air or oxygen is stirred into the suspension and is finely dispersed, or is injected via a spray nozzle. The oxidation can also be carried out in a column into which air or oxygen is injected in finely dispersed form at the bottom. The redox potential of the suspension is advantageously monitored during the oxidation of II to I in order to avoid peroxidation. The oxidation can be regarded as having ended when from 95 to 99% of the iron-II cyano compound has been oxidized to I.

When the process is carried out industrially, the iron-II complex does not have to be isolated, and can be oxidized directly in the electrolyte, and (I) is then isolated in a conventional manner.

If atmospheric oxygen or hydrogen peroxide is used for the oxidation, the filtrate from (I) can be re-used as the electrolyte, after the constituents consumed have been replaced.

Very fine-particled pigments I which are readily dispersible in water are obtained by oxidizing II with air or oxygen at pH>8 and at from 20° to 50° C. The process of the oxidation can be followed by measuring the redox potential. When the oxidation has ended, the reaction mixture is acidified and the pigment is isolated. Its dispersibility in water is improved by adding a small amount (ie. from 0.01 to 0.2% by weight, based on (I)) of a polyol, eg. diethylene glycol, triethylene glycol or glycerol, to the reaction mixture.

In the Examples which follow and which illustrate the invention, percentages are by weight and the potentials were measured against a standard hydrogen electrode.

EXAMPLE I

A tubular cell, the stainless steel wall of which was the cathode and which contained a central round rod-shaped compact iron anode (anode-cathode distance: about 4 mm; length of the cell: 600 mm), was filled with electrolyte solution comprising 97% of water, 2% of hydrogen cyanide and 1% of potassium bisulfate. Electrolysis was carried out at a current density of 1,000 A/m$^2$, a cell voltage of $\approx$2.5 V, a flow rate of the electrolyte of 1.2 m/second and an anode potential of $\approx -0.2$ V (measured against the standard hydrogen electrode) until the concentration of hydrogen cyanide in the electrolyte was 0.05%. The resulting Berlin white suspension was then brought to pH 1.5 with sulfuric acid and was oxidized by gassing with atmospheric oxygen at 88° C. (time: about 3 hours). The $MeFe[Fe(CN)_6]$ (Berlin blue) formed during the oxidation was filtered off and washed neutral with water. The filter cake was then dried at 120° C. to give a pigment yield of ≈97%, based on the hydrogen cyanide employed.

In surface coatings, the pigment gave purer and redder colorations of better gloss than products obtained from an iron-II salt and a sodium or potassium cyanoferrate-II by the prior art process.

EXAMPLE 2

The electrolysis cell described in Example 1 was filled with electrolyte solution comprising 93% of water, 5% of hydrogen cyanide and 2% of potassium chloride. Electrolysis was carried out at a current density of 1,500 $A/m^2$, a cell voltage of 2.0 V, a flow rate of 1.5 m/second and an anode potential of ≈−0.2 V (measured against the standard hydrogen electrode) until the concentration of hydrogen cyanide in the electrolyte was 0.04%. 5 mg of $Fe^{++}$ in the form of $FeSO_4$ were then added per liter of the resulting Berlin white suspension, and the pH was brought to 1.0 with sulfuric acid. Oxidation to the pigment and working up were carried out as in Example 1.

A very soft-textured pigment which, compared with the prior art pigments, gave purer and redder colorations of superior gloss in surface coatings and in printing inks was obtained. The colorations were about 19% deeper than colorations which had been obtained with the corresponding pigments of highest color strength commercially available.

EXAMPLE 3

The electrolysis cell described in Example 1 was filled with electrolyte solution comprising 88% of methanol, 1.5% of water, 10% of hydrogen cyanide and 0.5% of potassium chloride. Electrolysis was carried out at a current density of 1,200 $A/m^2$, a cell voltage of 4.8 V, a flow rate of 1.8 m/second and an anode potential of ≈−0.2 V (measured against the standard hydrogen electrode) until the concentration of hydrogen cyanide in the electrolyte was 0.02%. This suspension was filtered on a suction filter under nitrogen, and the Berlin white isolated was introduced into a quantity of water sufficient to give an 8% strength suspension. The aqueous suspension was brought to pH 1.0 with dilute sulfuric acid and, after addition of 0.15% of potassium chlorate (based on the suspension), oxidation was carried out at 80° C. for 1 hour. The $MeFe[Fe(CN)_6]$ pigment (Berlin blue) obtained in the oxidation was worked up as described in Example 1.

EXAMPLE 4

Electrolysis was carried out as described in Example 2, but the resulting suspension was filtered under nitrogen and the material on the filter was introduced into a quantity of water sufficient to give a 5% strength suspension. The suspension was brought to pH 12 with aqueous 25% strength potassium hydroxide solution and oxidation was carried out with atmospheric oxygen at 30° C. (time: about 1 hour). After the oxidation, the suspension was acidified to pH 1 with dilute sulfuric acid, and the Berlin blue was worked up as described in Example 1. A fine-particled pigment, which was very readily dispersible in water to which a little triethylene glycol had been added, was obtained.

EXAMPLE 5

The procedure followed was as described in Example 1, but the following solutions were used as the electrolyte:

5.1 93% of water, 5% of hydrogen cyanide and 2% of $MgCl_2$ 5.2 93% of water, 5% of hydrogen cyanide and 2% of $CaCl_2$ 5.3 93% of water, 5% of hydrogen cyanide and 2% of $Al(H_2O)_6Cl_3$ 5.4 93% of water, 5% of hydrogen cyanide and 2% of $Ce_2(SO_4)_3$ 5.5 91% of water, 5% of hydrogen cyanide and 2% of $NiSO_4$+2% of $KHSO_4$ The electrolysis was discontinued at a hydrogen cyanide content of 0.05%. The suspensions were then oxidized by gassing with air at pH 1.5 and at 80° C. (time: about 3 hours). The products were separated off, washed and dried to give pigments which produced high-hiding colorations in surface coatings. Pigments which gave more or less greenish blue colorations were obtained, depending on the alkaline earth metal or earth metal used.

| Pigment from | Hue in toluene gravure printing | |
|---|---|---|
| 5.1 | significantly greener | than colorations produced by the pigment commercially available under the name Miloriblau R 1090. |
| 5.2 | significantly greener | |
| 5.3 | significantly greener | |
| 5.4 | a little greener | |
| 5.5 | substantially greener | |

We claim:

1. In a process for the preparation of blue iron hexacyanoferrate-III pigments, wherein the iron-II hexacyanoferate-II compound is prepared, isolated and then oxidized to the blue pigment, the improvement wherein the iron-II-hexacyanoferrate-II compound is prepared by anodic oxidation of metallic iron at pH<7 and at an anode potential of <0.76 V—measured against the standard hydrogen electrode—at from −20° to 150° C., in a reaction medium comprising hydrogen cyanide, in a suitable solvent.

2. A process as claimed in claim 1, wherein the anodic oxidation of the iron is carried out at a pH of from 2 to 5.

3. A process as claimed in claim 1 or 2, wherein the reaction medium contains one or more conductive salts.

4. A process as claimed in claim 3, wherein the conductive salts used are potassium or ammonium salts or mixtures of these.

5. A process as claimed in claim 1 or 2, wherein the anodic oxidation is carried out at from −5° to 25° C.

6. A process as claimed in claim 3, wherein the anodic oxidation is carried out at from −5° to 25° C.

7. A process as claimed in claim 1, wherein the oxidation of the iron-II hexacyanoferrate-II compound is carried out by means of air or oxygen, at a pH of from 0 to 3 and at from 70° to 95° C.

8. A process as claimed in claim 1, wherein the oxidation of the iron-II hexacyanoferrate-II compound is carried out with air or oxygen at pH>8 and at from 20° to 50° C.

* * * * *